US009486678B2

(12) United States Patent
Lamkin et al.

(10) Patent No.: US 9,486,678 B2
(45) Date of Patent: Nov. 8, 2016

(54) MULTI-HELIX GRIP

(71) Applicant: Lamkin Corporation, San Diego, CA (US)

(72) Inventors: Robert J. Lamkin, San Diego, CA (US); Carl W. Pettersen, San Diego, CA (US); Kerri Kauffman, San Diego, CA (US); Adam Colton, San Diego, CA (US); Patricia Marquez, Tijuana (MX); Carlos Rodriguez, Tijuana (MX); Ting Lau, San Diego, CA (US); Raul Medina, Tijuana (MX)

(73) Assignee: Lamkin Corporation, San Diego, CA (US)

( * ) Notice: Subject to any disclaimer, the term of this patent is extended or adjusted under 35 U.S.C. 154(b) by 0 days.

(21) Appl. No.: 14/325,121

(22) Filed: Jul. 7, 2014

(65) Prior Publication Data

US 2016/0001147 A1 Jan. 7, 2016

(51) Int. Cl.
*A63B 53/14* (2015.01)

(52) U.S. Cl.
CPC ..... *A63B 53/14* (2013.01); *A63B 60/14* (2015.10)

(58) Field of Classification Search
CPC ..... A63B 53/14; A63B 59/0029; A63B 59/0033; A63B 60/06; A63B 60/14
See application file for complete search history.

(56) References Cited

U.S. PATENT DOCUMENTS

D173,110 S * 9/1954 Karns ..... 473/302
3,028,283 A * 4/1962 Lundgren ..... A63B 53/14 156/297
3,140,873 A * 7/1964 Goodwin ..... A63B 53/14 473/302
3,845,954 A 11/1974 Case
5,145,171 A * 9/1992 Head ..... A63B 49/08 40/915
D363,963 S * 11/1995 Boone ..... D21/756
5,634,859 A 6/1997 Nesbitt
5,653,643 A * 8/1997 Falone ..... A63B 53/14 473/300
5,686,158 A * 11/1997 Gibbon ..... A63B 53/14 428/327
5,909,912 A * 6/1999 Mueller ..... A63B 49/08 29/446
6,234,920 B1 5/2001 Wang
6,235,134 B1 5/2001 Mueller
6,352,662 B1 3/2002 Murphy et al.
D478,141 S * 8/2003 Huang ..... D21/756
6,666,777 B1 * 12/2003 Lamkin ..... A63B 53/14 473/300
6,669,584 B1 * 12/2003 Miller ..... A63B 59/0014 473/568
6,696,659 B1 * 2/2004 Wallace ..... B23H 9/008 219/69.17
6,800,234 B2 * 10/2004 Ferguson ..... B29C 33/3857 205/70

(Continued)

FOREIGN PATENT DOCUMENTS

GB 344375 A 2/1931
GB 2120557 A * 12/1983 ..... A63B 53/14
WO 200958167 A 5/2009

*Primary Examiner* — Stephen Blau
(74) *Attorney, Agent, or Firm* — Procopio, Cory, Hargreaves & Savitch LLP

(57) ABSTRACT

A molded golf grip for a golf club includes first simulated wrap, and a second simulated wrap. The first simulated wrap includes a first wrap surface extending in a helical pattern. The first wrap surface includes a first wrap surface texture and a first wrap width that is less than a pitch of the helical pattern. The second simulated wrap includes a second wrap surface extending in a second helical pattern intertwined helically with the first wrap surface. The second wrap surface includes a second wrap surface texture that is different than the first wrap surface texture and a second wrap width that is less than the pitch. The first simulated wrap and the second simulated wrap are molded as a single body forming a shaft opening there within.

4 Claims, 4 Drawing Sheets

(56) References Cited

U.S. PATENT DOCUMENTS

| | | | | | |
|---|---|---|---|---|---|
| D525,332 | S | * | 7/2006 | Miller | D21/756 |
| D525,672 | S | * | 7/2006 | Miller | D21/756 |
| D525,673 | S | * | 7/2006 | Miller | D21/756 |
| D532,472 | S | * | 11/2006 | Schauffele | D21/756 |
| D534,607 | S | * | 1/2007 | Norton | D21/756 |
| 7,399,235 | B2 | * | 7/2008 | Gill | A01K 87/08 473/297 |
| D629,857 | S | * | 12/2010 | Gill | D21/756 |
| 8,641,553 | B2 | | 2/2014 | Gill et al. | |
| 2002/0082110 | A1 | | 6/2002 | Chen | |
| 2003/0139223 | A1 | | 7/2003 | Ulrich et al. | |
| 2004/0259661 | A1 | | 12/2004 | Chen | |
| 2010/0011483 | A1 | * | 1/2010 | Pinkart | A63B 53/14 2/161.3 |

* cited by examiner

MULTI-HELIX GRIP

TECHNICAL FIELD

The present disclosure generally pertains to golf grips, and is also directed toward a golf grip including a simulated wrap style golf grip with multiple helices.

BACKGROUND

Grips for sporting implements such as golf clubs have taken numerous forms over the years. Early grips consisted of a material, such as leather, wrapped around the handle portion of the golf club. Over the years other materials such as polyurethane have been used as a wrap material.

Golf grips have evolved from the wrap type grip to a molded type grip generally formed by a compression molding or an injection molding process. These molded grips are generally a tapered cylinder of rubber, polyurethane, TPE, or similar elastomeric and shock absorbing materials that slip over the butt end of a golf club shaft. Golf grips may also include fibers, cords, fabric, or cork imbedded within the elastomeric materials.

The texture of the golf grip surface may be selected based on the playing conditions and on a golfer's preferences. For example, a smoother, tackier surface may be selected for dry weather conditions, while a rougher, textured surface may be selected for wet weather conditions. Gripping features that recede into or protrude out from the surface of the golf grip are often included to provide further traction to help a golfer retain the club securely in the golfer's hands.

SUMMARY OF THE DISCLOSURE

In embodiments, a molded golf grip for a golf club includes a butt end, a tip end distal to the butt end, a first simulated wrap, a second simulated wrap and an end cap. The first simulated wrap includes a first wrap surface extending in a helical pattern between the butt end and the tip end. The first wrap surface includes a first wrap surface texture and a first wrap width that is less than a pitch of the helical pattern. The second simulated wrap includes a second wrap surface extending in a second helical pattern between the butt end and the tip end and intertwined helically with the first wrap surface. In some embodiments, the second helical is parallel to the first helical pattern by maintaining the same pitch. In other embodiments, the second helical pattern is not parallel to the first helical pattern by maintaining a different pitch. The second wrap surface includes a second wrap surface texture that is different than the first wrap surface texture and a second wrap width that is less than the pitch. The first simulated wrap and the second simulated wrap are molded as a single body forming a shaft opening there within. The end cap is at the butt end adjoining the first simulated wrap and the second simulated wrap.

Other features and advantages of the present invention should be apparent from the following description which illustrates, by way of example, aspects of the invention.

DETAILED DESCRIPTION

The apparatus disclosed herein includes a molded golf grip including a body with multiple simulated wraps oriented in adjacent helical patterns. In embodiments, the body includes a first simulated wrap having a first surface texture and a second simulated wrap having a second surface texture, different than the first surface texture. The varying surface textures of the first simulated wrap and the second simulated wrap may provide for a smoother surface on one of the simulated wraps which may provide an increased contact area for dry weather conditions and a rougher surface on the other of the simulated wraps which may provide texture for wet weather conditions.

Figure 1:
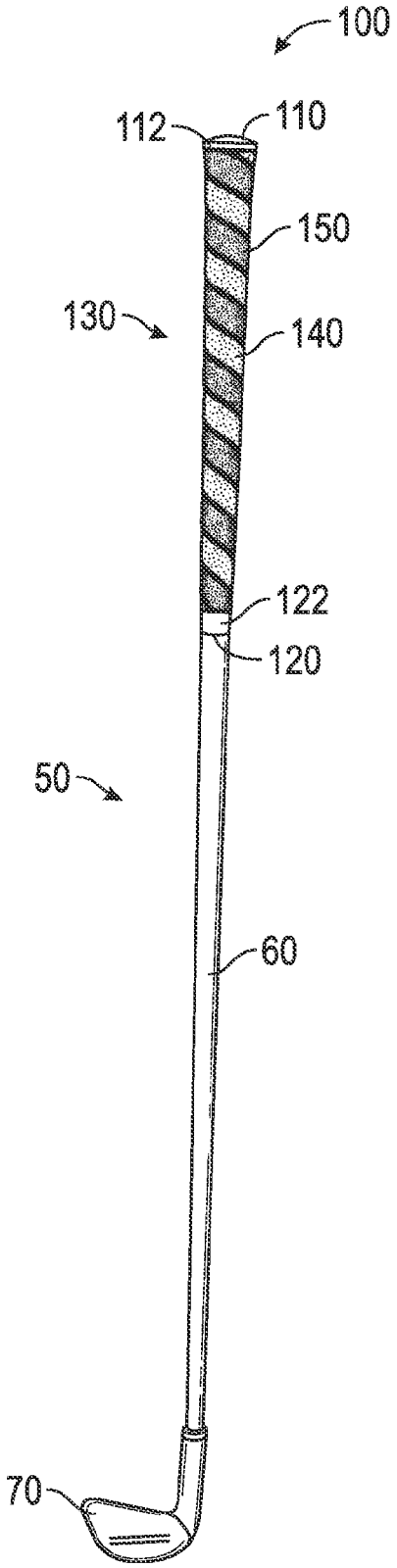
FIG. 1 is a perspective view of a golf club including a golf grip with multiple helices.

FIG. 1 is a perspective view of a golf club 50 with a golf grip ("grip") 100. Golf club 50 includes a shaft 60, a club head 70, and a golf grip such as grip 100. The shaft 60 may be a steel or graphite cylindrical tube. The length of shaft 60 is generally determined by the type of club head 70 attached and by the length of the measurement from the golfer's wrist to the floor. The club head 70 may be formed from any number of materials from processes such as forging and casting. Club head 70 may be any type of club head such as a driver, wood, hybrid, iron, or putter club head. Club head 70 is affixed to one end of shaft 60.

Grip 100 includes a butt end 110 and a tip end 120. Grip 100 may be affixed to shaft 60 at the end of shaft 60 distal to club head 70 by inserting shaft 60 into the tip end 120 of grip 100.

Grip 100 may include an end cap 112 at butt end 110 and a body 130 extending from the end cap 112 to the tip end 120. Grip 100 also includes multiple simulated wraps oriented in adjacent helical patterns and a tip 122 at tip end 120. The multiple simulated wraps and tip 122 may be molded into body 130. In the embodiment illustrated, grip 100 includes a first simulated wrap 140 and a second simulated wrap 150.

Figure 2:
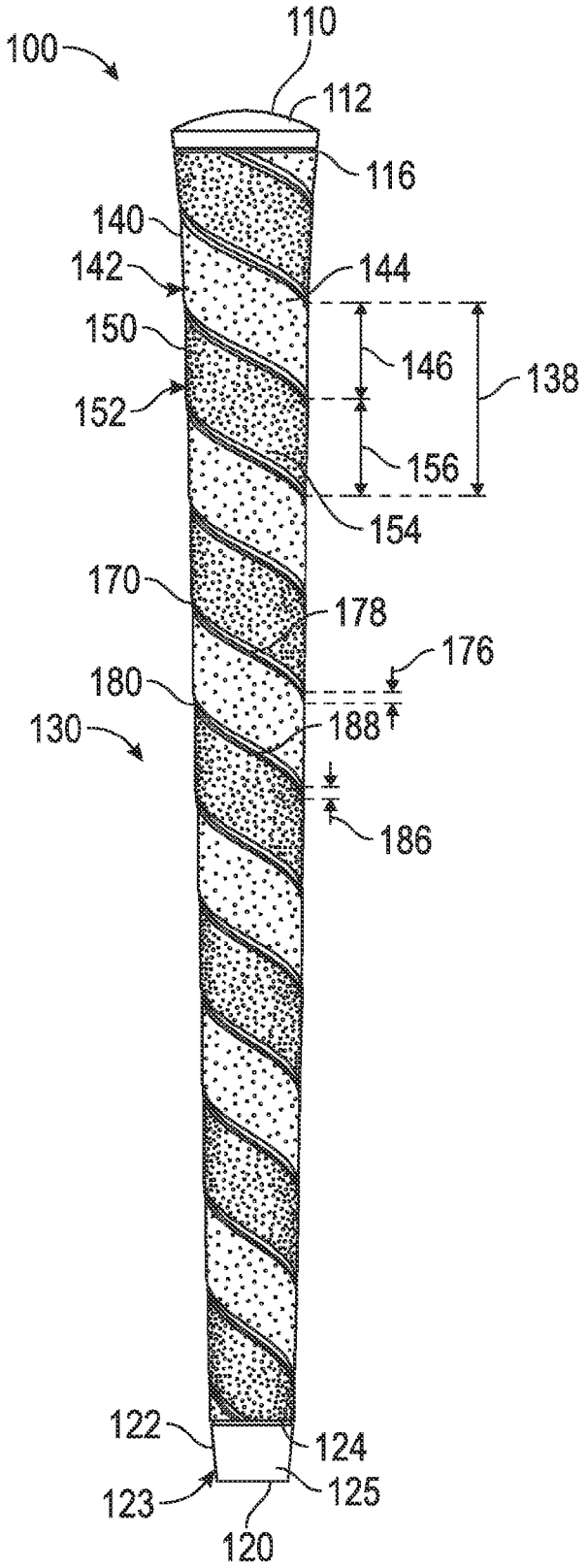
FIG. 2 is a side view of an exemplary embodiment of the golf grip of FIG. 1.

FIG. 2 is a side view of an exemplary embodiment of the grip 100 of FIG. 1. As illustrated, the grip 100 includes multiple simulated wraps intertwined helically in a multiple helix pattern. The embodiment illustrated in FIG. 2 shows two simulated wraps, a first simulated wrap 140 and a second simulated wrap 150, intertwined in a double helix pattern.

As illustrated, the first simulated wrap 140 includes a first wrap surface 142, a first wrap surface texture 144, and a first wrap width 146; and the second simulated wrap 150 includes a second wrap surface 152, a second wrap surface texture 154, and a second wrap width 156. The first wrap surface 142 and the second wrap surface 152 may each be a helical surface extending from the end cap 112 to the tip 122. The first wrap surface 142 and the second wrap surface 152 may be conic helices with each surface spiraling closer to the axis of the helices as each surface gets closer to the tip 122. Additionally, the first wrap surface 142 and the second wrap surface 152 may include a non-linear taper as each surface spirals closer to the tip 122.

The first wrap surface texture 144 and the second wrap surface texture 154 are different. In the embodiment illustrated in FIG. 2, the first wrap surface texture 144 is a partially roughened surface and the second wrap surface texture 154 is a roughened surface. The first wrap surface texture 144 and the second wrap surface texture 154 may be formed with any surface texture from a smooth surface to a highly roughened surface or any texture in between provided that the two textures are different. Examples of surface textures include natural surfaces, simulated leather grains, simulated wood grains, geometric patterns, mixed reflective surfaces, matte finished, high-gloss, and artwork derived patterns.

The width of each simulated wrap, such as first simulated wrap 140 and second simulated wrap 150 is less than the pitch 138 of the helical patterns of the simulated wraps, the width of one complete turn of the simulated wraps. The pitch 138 may be the combined widths of all of the simulated wraps of the grip 100. In the embodiment illustrated, the pitch 138 of the first simulated wrap 140 and of the second simulated wrap 150 is the sum of the first wrap width 146 and the second wrap width 156. The first wrap width 146 may be the shortest distance between the edges of the first simulated wrap 140, and the second wrap width 156 may be the shortest distance between the edges of the second simulated wrap 150. In the embodiment illustrated, the first wrap width 146 and the second wrap width 156 are equal. In other embodiments, the second wrap width 156 may be different, such as wider or narrower, than the first wrap width 146.

Grip 100 may include multiple skives between the simulated wraps. Each skives may be a helical grove, such as a slot or a channel, molded into the body 130 forming the transition between adjacent simulated wraps. Each skive may be symmetrical between simulated wraps with its narrowest portion at the midpoint between the simulated wraps. Each skive may transition between the adjacent simulated wraps. Grip 100 may include the same number of skives as simulated wraps. Skives may also be conic helices that spiral closer to the axis of the helices as each skive gets closer to the tip 122.

In the embodiment illustrated in FIG. 2, grip 100 includes a first skive 170 and a second skive 180. First skive 170 is a transition between the first simulated wrap 140 and an adjacent simulated wrap, such as the second simulated wrap 150. In the embodiment illustrated, first skive 170 forms the edge of first simulated wrap 140 closer to end cap 112 and the edge of second simulated wrap 150 closer to tip 122. Second skive 180 is a transition between the second simulated wrap 150 and an adjacent simulated wrap, such as the first simulated wrap 140. In the embodiment illustrated, second skive 180 forms the edge of the second simulated wrap 150 closer to end cap 112 and the edge of first simulated wrap 140 closer to tip 122.

First skive 170 includes a first skive width 176, and second skive 180 includes a second skive width 186. In the embodiment illustrated, first skive width 176 and second skive width 186 are equal. In other embodiments, second skive width 186 may be different, such as wider or narrower, than first skive width 176. The skive widths, such as first skive width 176 and second skive width 186, are generally narrower than the simulated wrap widths, such as first wrap width 146 and second wrap width 156.

Each skive may include a score, such as a seam or groove. The score may be a helical pattern within the skive. The score may be the narrowest point of body 130 across the skive. In the embodiment illustrated, first skive 170 includes a first score 178 and second skive 180 includes a second score 188. In the embodiment illustrated, first score 178 is centered in first skive width 176, and second score 188 is centered in second skive width 186. In other embodiments, the score may be asymmetrically located within the skive width.

The width of each simulated wrap may be defined as the distance between the scores within the skives. For example, the first wrap width 146 may be the distance between the first score 178 and the second score 188 across the first simulated wrap 140. The second wrap width 156 may be the distance between the first score 178 and the second score 188 across the second simulated wrap 150.

In the embodiment illustrated, end cap 112 includes an end cap feature 116. End cap feature 116 may be an aesthetic feature such as a trim ring extending around the circumference of the end cap 112 opposite the butt end 110 relative to the end cap 112. End cap feature 116 may be located at the transition between the end cap 112 and the body 130. End cap feature 116 may be a slot in grip 100 and may have a color that is different than the color of the remainder of end cap 112 or of body 130. The color of end cap feature 116 may be provided after molding, such as by painting. In the embodiment shown, end cap feature 116 is a circumferential slot that extends completely around end cap 112. In other embodiments, end cap feature 116 may include two or more circumferential slots aligned to form the circular shape. In yet other embodiments, end cap feature 116 may include more than one row of circumferential slot(s).

Tip 122 may generally include a hollow cylinder shape. Tip 122 may be tapered and may include a funnel shape, such as a hollow frusto-conical shape with the narrow end of the frustum located at tip end 120. Tip 122 may include a tip feature 124. Tip feature 124 may be an aesthetic feature such as a trim ring extending around the circumference of the tip 122 opposite the tip end 120 relative to the tip 122. Tip feature 124 may be located at the transition between the tip 122 and the simulated wraps. Tip feature 124 may be a slot in grip 100 and may have a color that is different than the color of the remainder of tip 122 and body 130. The color of tip feature 124 may be provided after molding, such as by painting. In the embodiment shown, tip feature 124 is a circumferential slot that extends completely around tip 122. In other embodiments, tip feature 124 may include two or more circumferential slots aligned to form the circular shape. In yet other embodiments, tip feature 124 may include more than one row of circumferential slot(s).

Tip 122 may also include a tip surface 123 and a tip surface texture 125. Tip surface 123 may be a conical frustum extending between tip feature 124 and tip end 120 with the narrow side of the conical frustum at tip end 120. The tip surface texture 125 may match the surface texture of one of the wrap surface textures (as illustrated in FIGS. 3 and 4) or may be different than all of the surface textures (as illustrated in FIG. 2).

The helical patterns including the first simulated wrap 140, the second simulated wrap 150, the first skive 170, and the second skive 180 may extend between the end cap 112 and the tip 122. In the embodiment illustrated, the helical pattern extends from the end cap feature 116 to the tip feature 124. In other embodiments, the helical patterns extend from the end cap 112 to the tip end 120.

Figure 3:
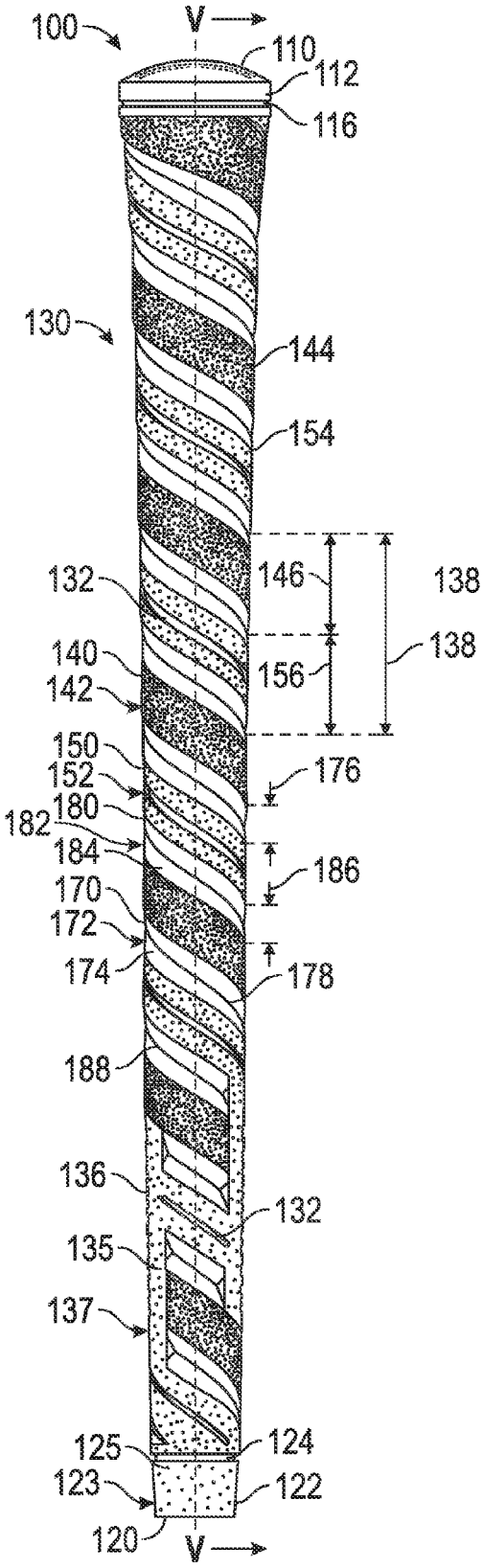
FIG. 3 is a side view of an alternate embodiment of the golf grip of FIG. 2.
Figure 4:
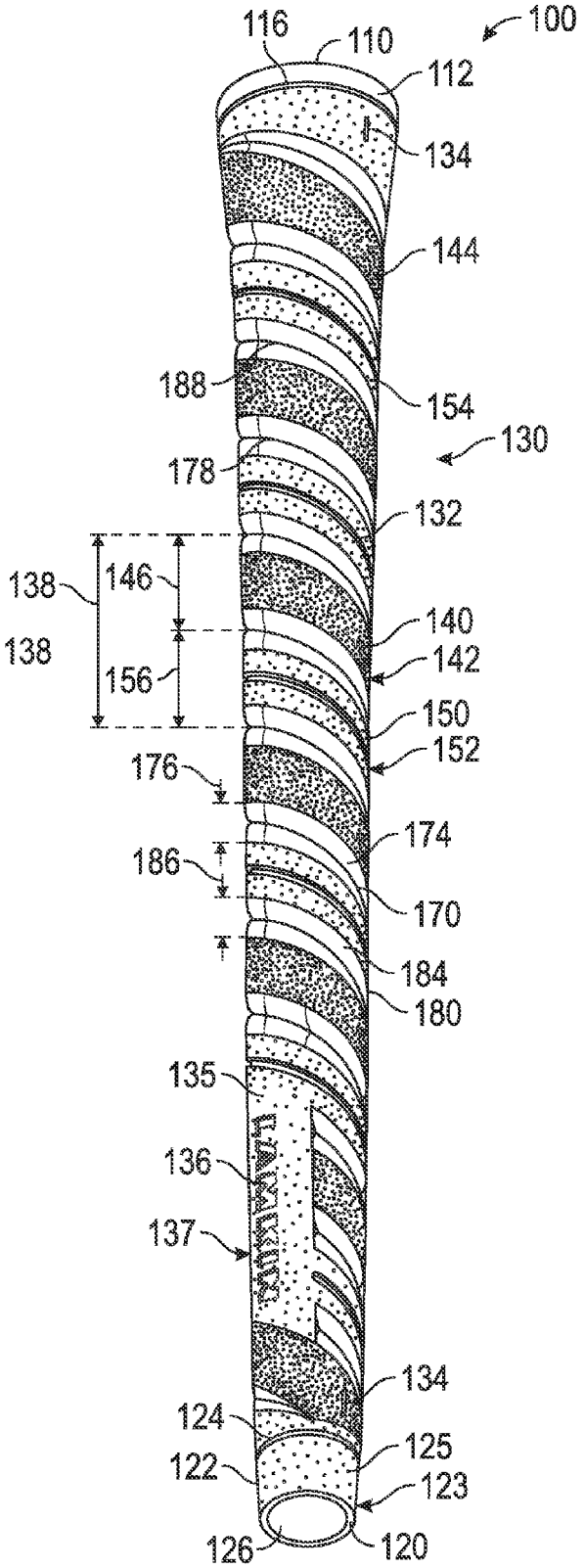
FIG. 4 is a perspective view of the golf grip of FIG. 3.

FIG. 3 is a side view of an alternate embodiment of the grip 100 of FIG. 2. FIG. 4 is a perspective view of the golf grip of FIG. 3. As illustrated in FIGS. 3 and 4, the skives widths, such as first skive width 176 and second skive width 186 may be over 50 percent of the wrap widths, such as first wrap width 146 and second wrap width 156. The skives also include a skive surface, such as first skive surface 172 and second skive surface 182, and a skive surface texture, such as first skive surface texture 174 and second skive surface texture 184. The first skive surface 172 may extend between the first wrap surface 142 and an adjacent wrap surface, such as second wrap surface 152. The second skive surface 182 may extend between the second wrap surface 152 and an adjacent wrap surface, such as first wrap surface 142. First skive surface 172 and second skive surface 182 may be at opposite sides of first wrap surface 142 and may be at opposite sides of second wrap surface 152.

In the embodiment illustrated in FIG. 3, first skive surface texture 174 and second skive surface texture 184 are different than first wrap surface texture 144 and second wrap surface texture 154. In other embodiments, first skive surface texture 174 and second skive surface texture 184 match either than first wrap surface texture 144 or second wrap surface texture 154. In other embodiments, the first skive surface texture 174 and the second skive surface texture 184 may vary, such as transitioning from the first wrap surface texture 144 to the second wrap surface texture 154, or one half of the skive surface texture matching the first wrap surface texture 144 on one side of the score and the other half of the skive surface texture matching the second wrap surface texture 154 on the other side of the score.

Each simulated wrap may include one or more gripping features 132, such as indents, slots, or protrusions. Gripping features 132 may extend into or protrude out from the simulated wrap from the wrap surface. Gripping features 132 may have any geometric shape, such as cylinders, prisms, or various shapes combined into a pattern, such as a crossed line pattern with a first line running in a first direction and two parallel lines crossing the first line at an angle. In the embodiment illustrated in FIGS. 3 and 4, gripping feature 132 is a helical slot located in second simulated wrap 150. As illustrated, gripping feature 132 is a continuous slot extending from the end cap 112 to the tip 122. In other embodiments, the helical slot may be segmented.

Grip 100 may include a logo area 135 within body 130. The logo area 135 may interrupt the helical patterns of the simulated wraps and of the skives. In the embodiment illustrated, the logo area 135 is located closer to the tip 122 than to the end cap 112. The logo area 135 may include a logo area surface 137 and a logo 136. In some embodiments, the logo area surface 137 may have the same or similar surface texture as a simulated wrap or a skive. In other embodiments, the logo area surface 137 has a surface texture that is different than the surface textures of the simulated wraps and skives. In the embodiment illustrated, the logo area surface 137 is a continuation of second wrap surface 152, does not interrupt second wrap surface 152, and includes the same surface texture as second wrap surface texture 154.

Logo 136 extends into body 130 from logo area surface 137. Logo 136 may be a symbol or a combination of letters, such as a Trademark of the manufacturer of the grip 100.

Figure 5:
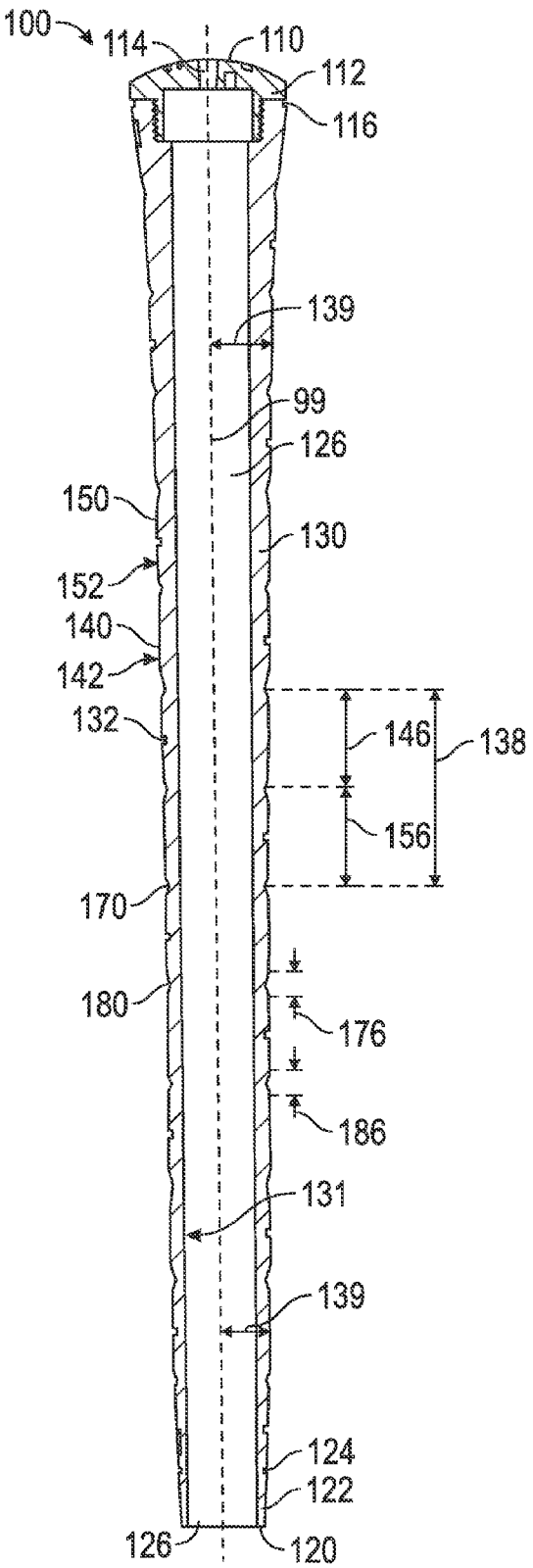
FIG. 5 is a cross-sectional view of the golf grip of FIGS. 3 and 4 taken along the line V-V in FIG. 3.

FIG. 5 is a cross-sectional view of the grip 100 of FIGS. 3 and 4 taken along the line V-V in FIG. 3. Each grip 100 may include an axis, such as axis 99. All references to radial, axial, and circumferential directions and measures refer to the grip axis, unless specified otherwise, and terms such as "inner" and "outer" generally indicate a lesser or greater radial distance from the axis. As illustrated, body 130 is a singular molded body including all of the simulated wraps and skives. In the embodiment illustrated in FIG. 5, body 130 also includes tip 122 and extends from end cap 112 to tip end 120.

The wrap surfaces, including first wrap surface 142 and second wrap surface 152, the skive surfaces, including first skive surface 172 and second skive surface 182, and the tip surface 123 may form the outer boundary of body 130. Body 130 also includes an inner surface 131 located radially inward from wrap surfaces and the skive surfaces. Inner surface 131 may form the inner boundary of body 130. Inner surface 131 matches the shape of the end of shaft 60 for golf club 50, and may be a right circular cylinder. Inner surface 131 forms the shaft opening 126 that the shaft 60 is inserted into.

Each wrap surface, such as first wrap surface 142 and second wrap surface 152 may be a conic helix that spirals in a helical pattern and tapers inward, such that the radius 139 of the wrap surfaces relative to the axis 99 gets smaller as the wrap surface gets closer to the tip 122 from the end cap 112. The tapering of the helical pattern may be linear, such as the taper on the surface of a cone, or may be non-linear, such as the taper on the surface of a funnel, a hyperbolic funnel or a pseudosphere. The skives, such as first skive 170 and second skive 180 may also be conic helices.

End cap 112 is located adjacent the simulated wraps. End cap 112 is an end piece that closes the end of the grip 100 opposite the tip 122. End cap 112 may be a solid cylinder shape. Butt end 110 may form the axial base of end cap 112. In some embodiments, butt end 110 is a flat circular surface. In other embodiments, such as the embodiment illustrated, butt end 110 is a spherical cap. End cap 112 may include a vent hole 114 extending there through. Vent hole 114 may be used to insert compressed air during installation and removal of grip 100 from a golf club. End cap 112 may be a separate pre-molded piece that is later secured to the body 130 as the body 130 is being molded or may be an integral piece molded as part of the body 130.

Figure 6:
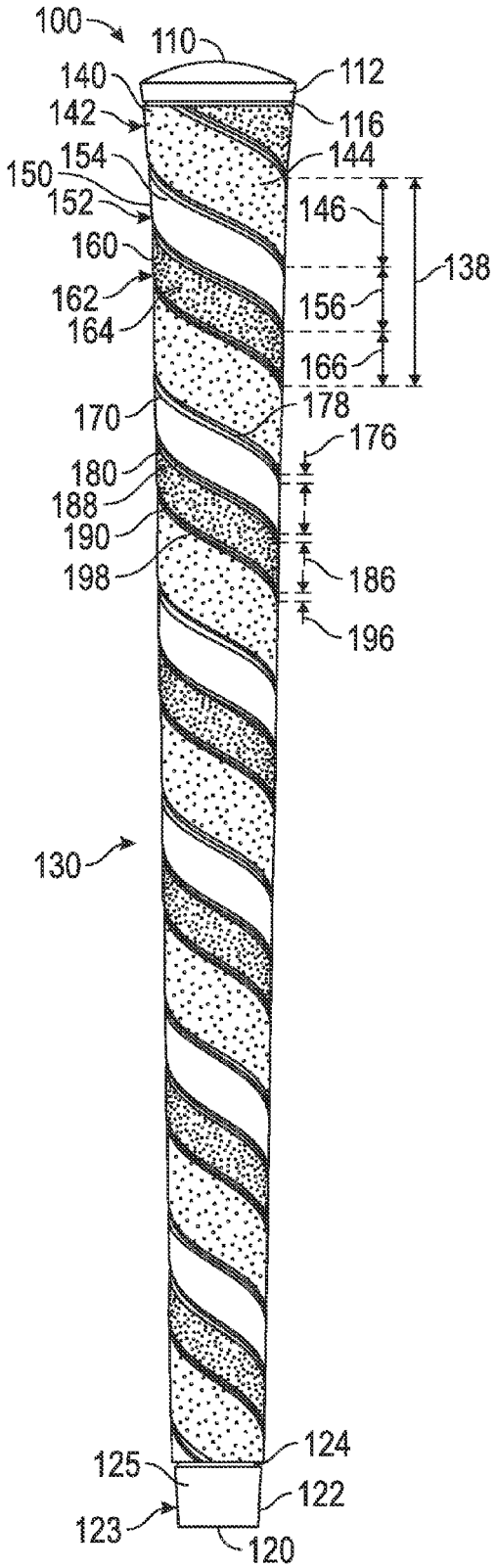
FIG. 6 is a side view of an alternate embodiment of the golf grips of FIGS. 2-5.

FIG. 6 is a side view of an alternate embodiment of the grips 100 of FIGS. 2-5. In the embodiment illustrated in FIG. 6, body 130 includes three simulated wraps, first simulated wrap 140, second simulated wrap 150, and third simulated wrap 160, as well as three skives, first skive 170, second skive 180, and third skive 190. Third simulated wrap 160 may include a third wrap surface 162, a third wrap surface texture 164, and a third wrap width 166. The third wrap surface 162 is a helical surface and may taper inward in the same or a similar manner as first wrap surface 142 and second wrap surface 152. The third wrap surface texture 164 is different than at least one of the first wrap surface texture 144 and the second wrap surface texture 154. In some embodiments, third wrap surface texture 164 is different than the first wrap surface texture 144 and the second wrap surface texture 154.

In some embodiments, such as those illustrated in FIGS. 2-4, the wrap widths are the same. In other embodiments, such as the embodiment illustrated in FIG. 6, one or more of the wrap widths may be different. In the embodiment illustrated in FIG. 6, first wrap width 146 is wider than second wrap width 156 and third wrap width 166, while second wrap width 156 and third wrap width 166 are equal. In other embodiments, all three or more wrap widths may be different.

Third skive 190 may be the same or similar to first skive 170 and second skive 180 as previously described. Third skive 190 may include a third skive surface, a third skive surface texture, and a third score 198. Third skive surface is a helical surface and may be a conic helix. Third skive surface texture may match first skive surface texture 174 and second skive surface texture 184, may match one or more wrap surface texture, or may not match any other surface texture.

Third skive width 196 may be the same as first skive width 176 and second skive width 186. In some embodiments, third skive width 196 is different than first skive width 176 and second skive width 186, such as wider or narrower than first skive width 176 and second skive width 186.

Third score 198 may follow a helical pattern within third skive 190. Third score 198 may be the narrowest point of body 130 across third skive 190. Third score 198 may be centered in third skive width 196 or may be asymmetrically located within third skive width 196.

Grips 100 may be made from materials such as rubber, polyurethane, TPE, foams, or similar elastomeric and shock absorbing materials. Grips 100 may also be composites and may include fibers, cords, fabric, or cork imbedded within the elastomeric materials.

Grips 100 including the simulated wraps with varying surface textures may help a golfer retain the golf club securely in a golfer's hands in varying conditions, such as dry weather and wet weather conditions. One wrap surface may include a smooth tacky surface, while another surface texture may include a rougher surface. Grip 100 may also include various gripping features in the wrap surfaces. The smooth tacky surface may help a golfer hold the golf club in dry weather conditions, while the rougher surface and the gripping features may help a golfer hold the golf club in humid and wet weather conditions. In each instance, the help may allow the golfer to hold the golf club with a lighter or less pressure. Gripping a golf club with less pressure may reduce the tension in the muscles of the golfer, allowing a golfer to maintain a faster and more fluid swing, which may correlate to greater distances and accuracy of golf shots.

The multi-helix pattern including the various contrasting gripping surfaces, skives, and surface textures may provide a distinct aesthetic look as compared to other golf grips, such as a single wrap grip.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art.

What is claimed is:

1. A molded golf grip for a golf club comprising:

an end cap;

an integrally molded body adjoining the end cap, the body including a tip located distal to the end cap, a first simulated wrap including a first wrap surface extending in a helical pattern between the end cap and the tip, the first wrap surface including a first wrap surface texture and a first wrap width, a second simulated wrap including a second wrap surface extending in a second helical pattern between the end cap and the tip, and intertwined in a double helix pattern with the first wrap surface, the second wrap surface including a second wrap surface texture that is different than the first wrap surface texture and a second wrap width, a first skive forming a first transition between the first simulated wrap and the second simulated wrap at the edge of the first simulated wrap closest to the cap throughout the helical pattern and an edge of the second simulated wrap closest to the tip throughout the second helical pattern;

a second skive forming a second transition between the second simulated wrap and the first simulated wrap at the edge of the first simulated wrap closest to the tip throughout the helical pattern and the edge of the second simulated wrap closest to the cap throughout the second helical pattern;

wherein the first skive includes a first skive surface, the first skive surface including a first skive surface texture, and wherein the second skive includes a second skive surface, the second skive surface including a second skive surface texture; and wherein the first skive surface texture and the second skive surface texture are different than the first wrap surface texture and the second wrap surface texture.

2. The molded golf grip of claim 1, wherein the first wrap surface and the second wrap surface include a pitch that is equal to the sum of the first wrap width and the second wrap width.

3. The molded golf grip of claim 1, wherein the first wrap width and the second wrap width are equal.

4. The molded golf grip of claim 1, wherein the end cap is pre-molded and secured to the body while the body is being molded.

* * * * *